United States Patent [19]

Pugh et al.

[11] 4,042,135

[45] Aug. 16, 1977

[54] LOAD HANDLING VEHICLE

[75] Inventors: Stuart Pugh, Loughborough; Ridley Stokoe, Whitley Bay, both of England

[73] Assignee: The Liner Concrete Machinery Company Limited, Gateshead, England

[21] Appl. No.: 622,359

[22] Filed: Oct. 14, 1975

[30] Foreign Application Priority Data

Oct. 12, 1974 United Kingdom ..... 44295/74

[51] Int. Cl.[2] ..... E02F 3/38

[52] U.S. Cl. ..... 214/141; 212/39 MS; 280/6.11

[58] Field of Search ..... 214/141, 761, 762; 212/39 R, 39 A, 39 MS; 280/6.1, 6.11, 6 H

[56] References Cited

U.S. PATENT DOCUMENTS

| | | | |
|---|---|---|---|
| 3,680,714 | 8/1972 | Holmes | 212/39 A |
| 3,713,129 | 1/1973 | Buchholz | 212/39 R |
| 3,724,679 | 4/1973 | Brownell et al. | 212/39 R |
| 3,771,667 | 11/1973 | Becker et al. | 212/39 R |
| 3,792,780 | 2/1974 | Spain | 212/39 R |
| 3,824,578 | 7/1974 | Harders | 212/39 R |
| 3,841,493 | 10/1974 | Jackson et al. | 212/39 MS |
| 3,937,339 | 2/1976 | Geis et al. | 214/141 |

*Primary Examiner*—Robert J. Spar
*Assistant Examiner*—Ross Weaver
*Attorney, Agent, or Firm*—Sughrue, Rothwell, Mion, Zinn and Macpeak

[57] ABSTRACT

A load handling vehicle having a chassis with an engine, wheel, and a control cab, a hydraulically extensible and pivotable telescopic boom pivoted to supports mounted on the rear of the chassis, and a load handling carriage mounted on the free end of the boom.

The vehicle is provided with strain gauges mounted in connection with one axle of the chassis, and the gauges are electrically connected via a time delay circuit to an alarm, and valves for controlling the hydraulic operation of the boom, in order to signal impending instability, and to prevent dangerous instability from occurring.

6 Claims, 5 Drawing Figures

LOAD HANDLING VEHICLE

This invention concerns improvements in and relating to load handling vehicles where manipulation of the load by the driver can place the vehicle in an unstable position. With known vehicles it is possible to tip the vehicle over by lifting loads which make the vehicle unstable or by altering the position of the load by various means such as jacks, ropes, extending booms etc. Thus endangering the stability of the vehicle. Many safety devices have been put forward to give the driver audible warning and/or make the vehicle safe and it is an object of the present invention to provide a simple yet safe method of warning the driver when his vehicle is becoming unstable.

With conventional forklift vehicles it is possible only to raise or lower the forks relative to the vehicle chassis; any horizontal movement which may be required necessitates movements of the vehicle as a whole. Thus, known forklift vehicles suffer serious disadvantages when they are required to load, for example, container vehicles, aircraft fuselages or the like where the loading deck is at a height above the travelling surface of the forklift vehicle.

An object of the present invention is to provide a load handling vehicle capable safely of raising a load and placing it at a distance from the vehicle without movement of the vehicle chassis relative to the ground, whilst minimizing liability of the vehicle overloading or unbalancing.

According to the invention a load handling vehicle comprises a chassis, a telescopic extensible boom pivotally mounted on a boom support member at a rear end of the chassis and a jack between the chassis and boom for raising the boom and extension means for extending and retracting the boom which carries at its extremity a forklift carriage or other mechanical handling device, with a sensing device for detecting a predetermined level of turning moment of the boom relative to another part of the vehicle used as a reference and an audible and/or visible alarm operable by said sensing means to warn of possible overload or unstable conditions.

Preferably, the sensing device is a strain gauge mechanism situated in such a way that the turning moment about one of the vehicle's axles can be set to give positive audible and in conjunction with the strain gauge visible warning when the vehicle is about to become unstable.

The strain gauge is preferably mounted on or near the axle that is about to lift off the ground should the vehicle become unstable. It can, however, be located on any convenient stressed part of the vehicle that would give a sufficiently accurate reading. The vehicle in question has its front axle fixed, about which the vehicle could overturn and the strain gauge mounted on the rear axle which is held in a central point and pivots about this point for the purpose of stability and overcoming rough ground.

The detecting means may be a hydraulically operated load sensor responsive to the loading of the jack for raising the boom and preferably is arranged to prevent further lowering of the boom and/or extension of the telescopic boom whereby a predetermined maximum level of turning moment of the boom about the boom support member may not be exceeded. The maximum permissible moment is calculated with reference to that which would be required for overturning the vehicle.

The load sensor is preferably connected to the hydraulic fluid in the jack.

The boom is preferably extended and retracted hydraulically using chains or wire ropes to interlink section of the boom but as an alternative or additionally the boom may be pneumatically extended or a system of wire ropes and chains could be used to extend and retract the boom. The jack for raising and lowering the boom is preferably hydraulic but may be mechanically operated.

The strain gauge is preferably responsive to the loading of the boom preferably arranged to prevent further lowering of the boom and/or extension of the telescopic boom whereby a predetermined maximum lever of turning moment of the boom about the front axle may not be exceeded. The maximum permissible moment is calculated with reference to that which would be required for overturning the vehicle. The strain gauge preferably actuates the hydraulic control valves thus locking any further travel of the boom extension and/or lowering of the boom which would also constitute a situation where the vehicle would become unstable. It is also preferred that some sort of audible alarm should be given when an unstable condition is approaching. If required it is also possible to have a visual display in the driver's cab.

The invention is particularly, though not exclusively, intended for use on vehicles with a telescopically mounted boom, such a vehicle might have a forklift carriage, crane hook or loading bucket at the end of its telescopic boom. The strain gauge is preferably mounted in such a way as to give maximum protection to the gauges themselves and the wires leading therefrom, but it can also be mounted in various ways and in various places on the vehicle.

This invention will now be described further by way of example with reference to the accompanying drawings in which FIG. 1 shows the side elevation of one such vehicle having a pivotal boom mounted on a supporting rear member;

Figure 1:
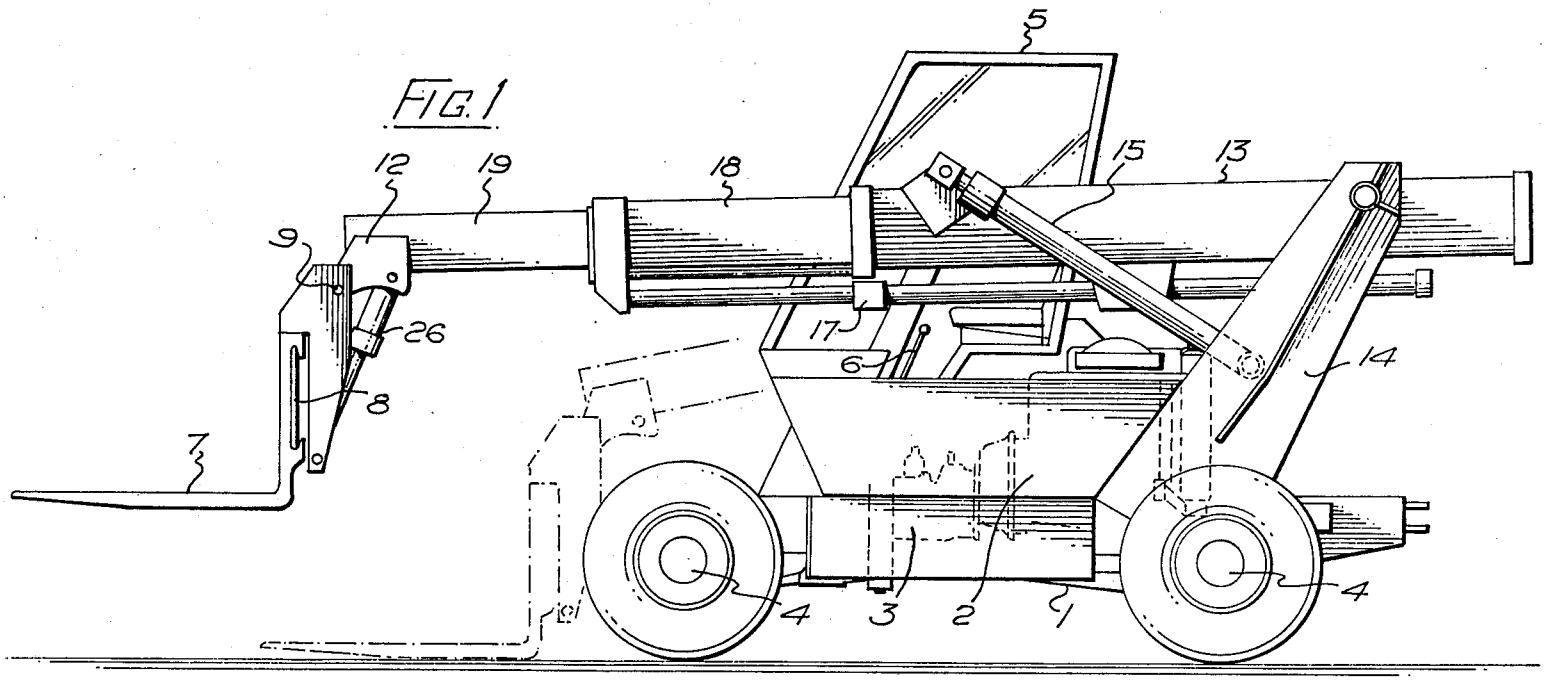
Figure 2:
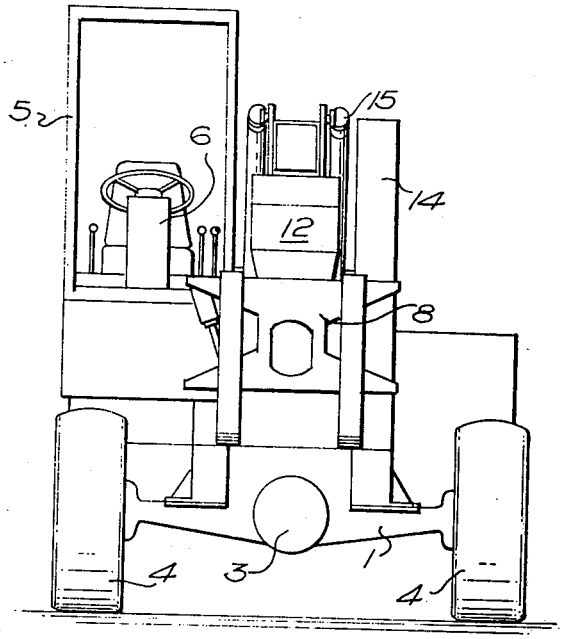
FIG. 2 shows an end elevation of the same machine.
Figure 3:
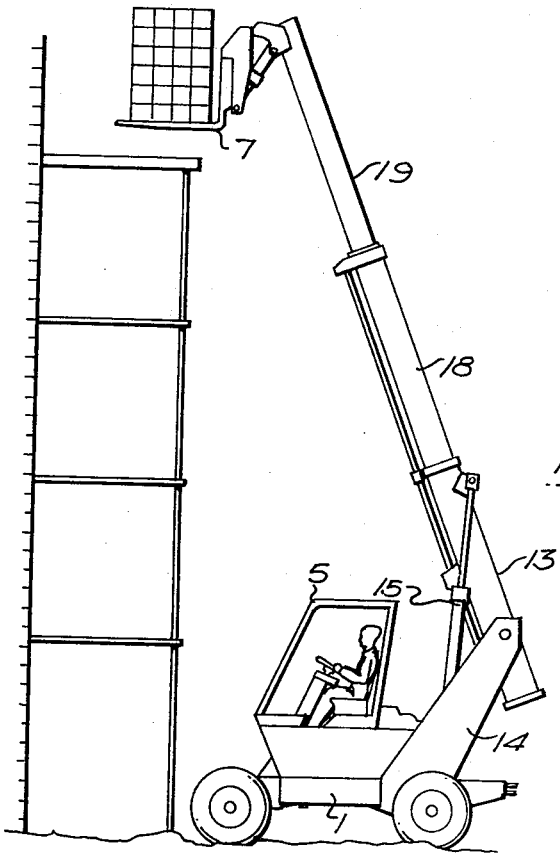
FIG. 3 shows the machine of FIGS. 1 and 2 with the boom elevated and a strain gauge operative.
Figure 4:
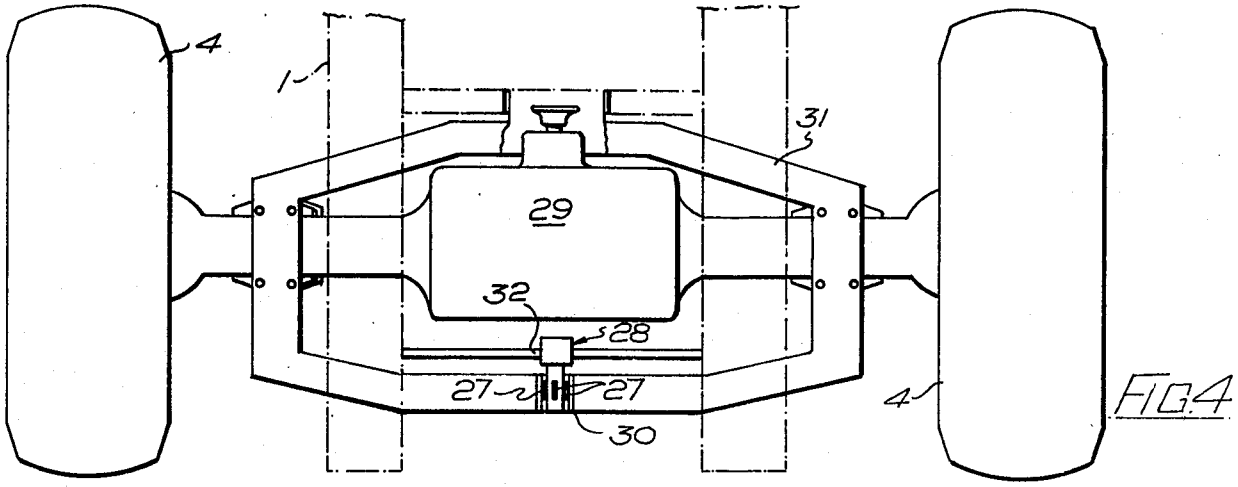
FIG. 4 indicates the use of an electrically actuated load sensor.
Figure 5:
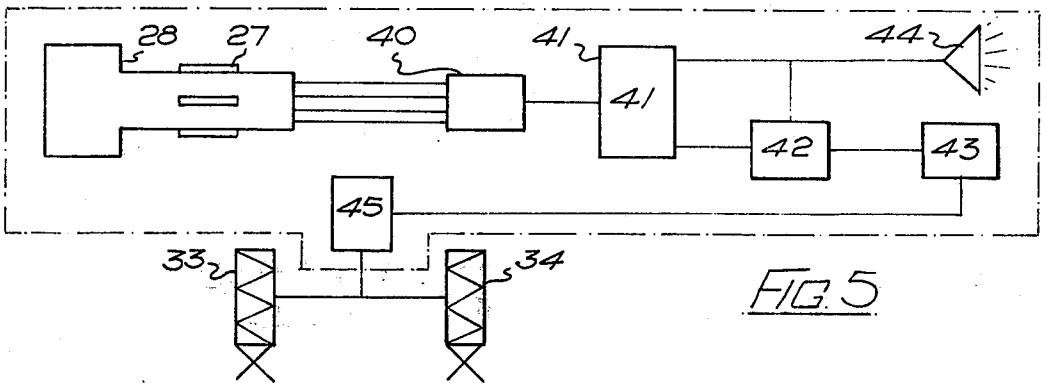
FIG. 5 shows the load sensor connected to the lifting and boom extension rams.

The chassis 1 has mounted on it an engine 2, gearbox 3 and four wheels on hubs 4. The four wheels are driven by the engine 2 and both front and rear pairs of wheels may be steered either in synchronism or in opposition to the other pair by which means a very tight turning circle may be obtained and the vehicle may perform crabbing movements.

The driver/operator is protected by an all-round view cab 5 and operates the vehicle by means of a steering wheel and levers 6. The cab is formed from high grade steel and has toughened glass windows for driver-/operator safety and the cab is positioned at the side of the chassis whereby the driver/operator may have a clear view of the forklift carriage or other mechanical handling device at all positions of the boom.

The telescopic boom 13 is hinged at the rear of the vehicle to a rear chassis member 14, and elevated by the elevation control rams 15, through hinge points 16. The boom is extended by a boom extension ram 17, which forces the second boom member 18 to extend. The inner third boom member is forced to extend by a chain and pulley system between the sections. By this means the desired height or reach of the carriage may be obtained. The boom is retracted in the reverse manner.

In a preferred embodiment, the chassis 1, carries pin, 28. On the pin strain gauges 27 are located with terminals leading through the pin. A bearing 30, carried by an intermediary member 31, is located on the pin in a carefully machined location 32. The axle member 29, pivots on the bearing 30 and allows the vehicle to travel over uneven ground thus keeping the four wheels in contact with the ground. The load at the back end of the machine is carried therefore, from the chassis 1 and the pin 28, through the bearing 30 and axle carrying member 29 and thus to the wheels.

Any load put on the bearing carrying member 31, is transmitted to the pin at point 32, thus putting a cantilevered strain on the pin 28. This has the effect of stretching or straining the strain gauges 27. The signal from the strain gauges is taken to an alarm system and/or to a dial diving a visual warning. The signal would also actuate the control valves stopping any further motion of the telescopic boom by the ram 15.

The signal from the strain gauges 27 is taken to an amplifier 40 which amplifies the signal and then through a time constant device 41, which holds the signal for a set time of 2 to 5 seconds before allowing it to pass to two level indicators 42, 43. These indicators analyse the signals from the strain gauges and constantly monitor them. Should this signal decrease to a certain level, the signal is passed through the first level indicator 42 to a buzzer 44. This warns the driver that the load is becoming unstable. If the driver ignores the warning buzzer and the load continues to decrease due to the load being taken off the strain gauges, due to the overloading of the machine, then the second level indicator 43 comes into operation and in turn passes the signal to a relay 45 which, in its turn, activates the respective solenoid valves 33, 34 which close down the boom lower and boom extension rams 15, 17; thus the driver has ample time and warning when he is entering an unstable situation. In order to bring the vehicle back to a safe condition the driver must retract the boom or raise the boom, in either case the turning moment will decrease on the back axle, the load will increase on the strain gauge 27 and the signal will rise on both level indicators 42, 43 thus releasing the hydraulic locks effected by the two valves 33, 34 and shut off the warning buzzer 44.

In a second embodiment, any hydraulically actuated load sensor is coupled to the ram 15, operative at a predetermined load setting corresponding to but less than, the turning moment required to overturn the vehicle. The load sensor is connected to a locking device preventing valve movements to retract ram 15 and extend ram 17 and to illuminate warning light in cab 5. Upon such safety-cut occuring the operator retracts the telescopic boom before lowering it further.

What is claimed is:

1. A load handling vehicle comprising: a chassis, axles carrying the chassis on wheels, a telescopically extensible boom pivotally mounted on said chassis, a jack between the chassis and said boom for raising the boom, a pin having strain gauges mounted thereon, said pin connecting the chassis to one of said axles, wherein when a turning moment of the chassis exceeds a predetermined level, said strain gauges operate an audible and/or visible alarm to warn of possible overload or unstable conditions.

2. A vehicle according to claim 1 wherein the strain gauge is mounted in association with the rear axle of the vehicle, the rear axle being held in a central location and pivotable about this location to negotiate rough ground.

3. A vehicle according to claim 1 wherein the boom is extendable and retractable hydraulically using chains or wire ropes to interlock the sections of the boom.

4. A vehicle according to claim 1 wherein the jack for raising and lowering the boom is hydraulic.

5. A vehicle according to claim 1, wherein the strain gauge is responsible to the loading of the boom preferably arranged to prevent further lowering of the boom and/or extension of the telescopic boom whereby a predetermined maximum level of turning moment of the boom about the front axle may not be exceeded.

6. A vehicle according to claim 5, wherein the strain gauge actuates the hydraulic control valves thus locking any further travel of the boom extension and/or lowering of the boom which would also constitute a situation where the vehicle would become unstable.

* * * * *